United States Patent [19]

Shacklett, Jr.

[11] Patent Number: 4,583,763

[45] Date of Patent: Apr. 22, 1986

[54] INFORMATION FOLDER CONSTRUCTION

[76] Inventor: James H. Shacklett, Jr., 2025 Joshua Rd., Lafayette Hill, Pa. 19444

[21] Appl. No.: 650,516

[22] Filed: Sep. 14, 1984

Related U.S. Application Data

[63] Continuation-in-part of Ser. No. 103,593, Dec. 14, 1979, abandoned, which is a continuation-in-part of Ser. No. 940,073, Aug. 25, 1978, abandoned, which is a continuation-in-part of Ser. No. 752,446, Dec. 20, 1976, abandoned.

[51] Int. Cl.[4] ..... B42D 19/00

[52] U.S. Cl. ..... 281/5; 281/2; 283/56; 283/62; 229/92.8

[58] Field of Search ..... 281/2, 5; 283/1 R, 56, 283/62; 229/70, 73, 92.8

[56] References Cited

U.S. PATENT DOCUMENTS

| | | | |
|---|---|---|---|
| 1,363,081 | 5/1930 | Brown | 283/62 |
| 2,270,455 | 1/1942 | Lichter | 229/92.8 |
| 2,723,078 | 11/1955 | Tilly | 224/92.8 |
| 4,010,964 | 3/1977 | Schecter | 283/56 |

*Primary Examiner*—Paul A. Bell

*Attorney, Agent, or Firm*—Robert K. Youtie

[57] ABSTRACT

An information folder wherein a strip of paper or like sheet material is subdivided by a plurality of generally equally spaced parallel scores into a plurality of generally rectangular panels having informative indicia marked thereon, and folds are provided along the scores defining hinge connections between panels, the strip being wound about one end panel into a flattened spiral with all the panels in generally congruent overlying relation with each other.

5 Claims, 4 Drawing Figures

FIG. 1
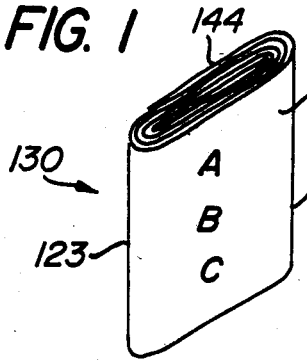
FIG. 2
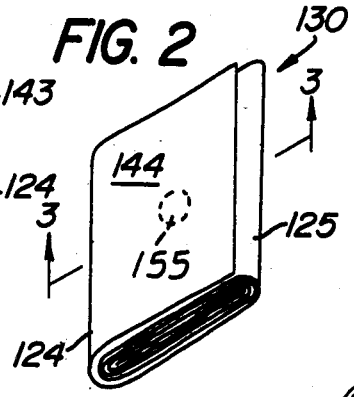
FIG. 3
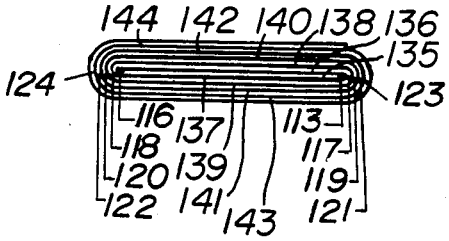
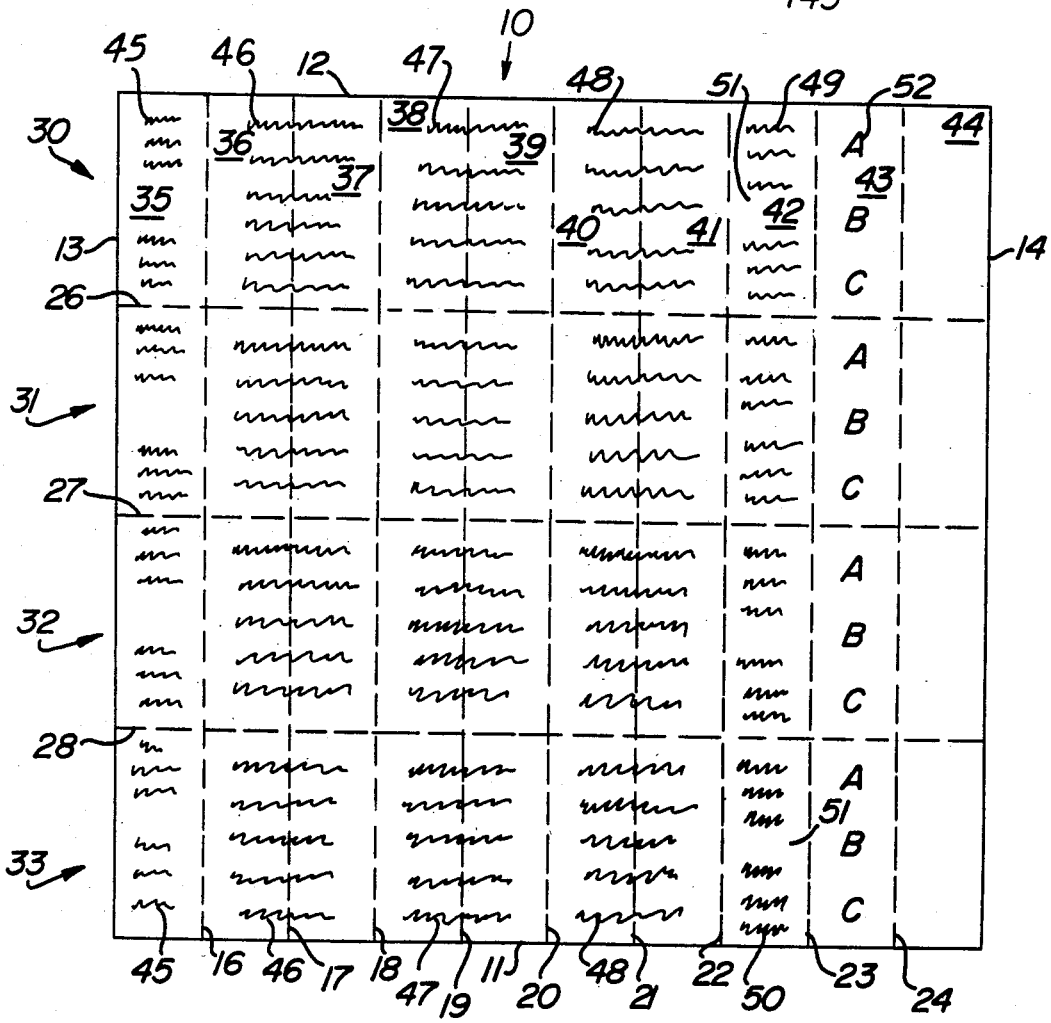
FIG. 4

INFORMATION FOLDER CONSTRUCTION

CROSS-REFERENCES TO RELATED APPLICATIONS

This application is a Continuation in part of copending application Ser. No. 103,593 filed Dec. 14, 1979, now abandoned a Continuation-in-Part of application Ser. No. 752,446 filed Dec. 20, 1976, now abandoned, and a Continuation-in-Part of application Ser. No. 940,073 filed Aug. 25, 1978, now abandoned.

BACKGROUND OF THE INVENTION

While the information folder of the present invention has been primarily developed for use in conjunction with the dispensing of drugs, as being imprinted with information required for use of the drugs, it is appreciated that the instant folder construction is capable of many varied applications, all of which are intended to be comprehended herein.

Prior drug information folders have generally been of accordion pleated structure and glued to the exterior of a container, or otherwise folded and inserted into an outer package or box.

However, such prior folder constructions and arrangements have been subject to certain disadvantages, for example the accordion pleated structure tends to open by inadvertence during handling prior to drug use, and insert type folders require extra production steps and packaging, both the exterior folders and inserted folders adding significantly to manufacturing costs and being inconvenient both in production and use.

SUMMARY OF THE INVENTION

It is, therefore, an important object of the present invention to provide an information folder which overcomes the above-mentioned difficulties, being capable of external application to a container without tendency to unfold, eliminating the need for insertion and external packaging, which is extremely simple in construction and capable of quick and easy manufacture by mass production techniques to effect substantial savings in costs.

It is still another object of the present invention to provide an information folder construction having the advantageous characteristics mentioned in the preceding paragraph, which is extremely simple to use, both in opening and reading, durable throughout the usual abusive handling in distribution, and which is adapted for ready association with drugs, and other articles by existing machinery.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a front perspective view showing an information folder construction in accordance with the teachings of the present invention.

FIG. 2 is a rear perspective view of the information folder of FIG. 1.

FIG. 3 is a sectional view taken generally along the line 3—3 of FIG. 2.

FIG. 4 is a plan view showing one side of a blank adapted to be formed into a plurality of information folders of the present invention, the other side may be identical.

DESCRIPTION OF THE PREFERRED EMBODIMENT

Referring now more particularly to the drawings, and specifically to FIG. 4 thereof, a multiple blank is there generally designated 10 and may be fabricated of paper or other suitably flexible and foldable sheet material. The blank 10 may be generally rectangular in outline configuration, including generally parallel, longitudinal lower and upper side edges 11 and 12, and end edges 13 and 14 extending in parallelism with each other generally normal to and between the side edges at opposite ends thereof. A plurality of generally parallel scores or folds 16, 17, 18, 19, 20, 21, 22, 23, and 24 are formed in the material of blank 10, being substantially equally spaced apart from each other and each extending generally normal to and between side edges 11 and 12. The scores 16–24 combine with the bounding edges 11–14 to subdivide the sheet 10 into a plurality of generally rectangular panels arranged in side-by-side adjacent relation and hingedly connected along their adjacent side edges by the several scores or folds 16–24.

Further, the blank 10 is severed into a plurality of longitudinally extending, parallel spaced severance lines or cuts 26, 27 and 28, extending in equally spaced parallelism with each other longitudinally of and between the side edges 11 and 12, generally normal to and intersecting with the end edges 13 and 14. The sheet 10 may be considered a gang blank being cut or severed into a plurality of substantially identical strips 30, 31, 32 and 33. Specifically, the elongate strip 30 is bounded within the end edges 13 and 14, side edge 12 and lower side cut 26, while the strip 31 is bounded between the end edges 13 and 14 and upper and lower longitudinal side cuts 26 and 27, the strip 32 being bounded within the end edges 13 and 14 and upper and lower longitudinal side cuts 27 and 28, and the strip 33 being bounded within the end edges 13 and 14, upper side cut 28 and lower side edge 11.

As all of the strips 30–33 are essentially identical only a single one will be described in further detail. In particular, strip 30 is subdivided by the partition lines, scores or folds 16–24 into a plurality of substantially identical, generally rectangular panels 35–44, which panels are disposed in side-by-side relation with their adjacent edges hingedly connected together by the intermediate fold lines or scores 16–24. Specifically, panel 35 is bounded within severance line 26, end edge 13, side edge 12 and fold or score 16; panel 26 being bounded within severance line or cut 26, fold 16, edge 12 and fold or score 17; panel 37 being bounded within cut 26, fold 17, edge 12 and fold 18; panel 38 being bounded within cut 26, fold 18, edge 12 and fold 19; panel 39 being bounded within cut 26, foldline 19, edge 12 and cut 20; panel 40 being bounded within cut 26, fold 20, edge 12 and fold 21; panel 41 being bounded within cut 26, fold 21, edge 12 and fold 22; panel 42 being bounded within cut 26, fold 22, edge 12 and fold 23; panel 43 being bounded within cut 26, fold 23, edge 12 and fold 24; and end panel 44 being bounded within cut 26, fold 24, edge 12 and edge 14.

Further, on at least one surface of strip 30 there is provided, as by imprinting or marking, suitably informative indicia, as required by circumstances. The end panel 35 is provided with indicia marking 45, while the end panels 36 and 37 are provided with indicia or marking 46. Similarly, adjacent panels 38 and 39 are provided with combined indicia or marking 47, and adjacent panels 40 and 41 are provided with combined indicia or marking 48. The single panel 42 is provided with indicia or marking 50, and it will be seen that the marking 50 is located spaced from the medial region of the panel, so as to leave an unmarked medial region 51.

Additionally, the panel 43, adjacent and hingedly connected to the end panel 44, may be considered as a title or front panel and is provided with titling or identifying indicia 52, while the end panel 44 may be devoid of indicia, if desired.

From the strip 30, there is formed the information folders 130 of FIGS. 1–3. In particular, the blank 10 is severed along the several cut lines 26, 27 and 28 to provide a plurality of strips, each of which forms a single folder 130. That is, a folder 130 includes an inner panel 135 connected by a foldline or hinge 116 to a next adjacent panel 136, which latter panel is swung about foldline 116 into facing, generally congruent relation with the innermost panel 135. Successively, hingedly connected to the other edge of panel 136, as by foldline or score 117 is a next adjacent panel 137 swung about said hinged connection into congruent facing relation with the innermost panel 135, on the opposite side of the latter as hingedly connected panel 136. Remote from the hinged connection or fold 117, the panel 137 is hingedly connected by a foldline or score 118 to a similar, generally rectangular panel 138, which is folded about hinged connection 118 into generally congruent facing relation with the several inner panels 135, 136 and 137. Additionally, remote from the hinged connection 118, the panel 138 is hingedly connected by a foldline 119 to a generally rectangular, substantially congruent panel 139, swung by the fold 119 into facing relation with the several panels 135–138; and, a further panel 140 is connected by the hinged foldline 120 to its adjacent panel 139 and swung into congruent facing relation with respect to the latter and the panels therebetween.

The panel 140 is connected by a hinged connection or foldline 121 to a further generally rectangular panel 141, the latter being swung about the folding line 121 into congruent facing relation with the several previously described inward panels, and the panel 141 is provided with a hinged connection or foldline 122 remote from the foldline 121 to still another generally rectangular panel 142, which is swung into generally congruent facing relation with the several inner panels. Finally, the title panel 143 is hingedly connected, as by a score or foldline 123 to the panel 142, remote from the hinged connection 122, being swung into congruent facing relation with the inner panels, and the outermost panel 144 is swung about a hinged connection or foldline 124 with respect to the title or front panel 143.

It will thus be appreciated that the several panels 135, 136, 137, 138, 139, 140, 141, 142, 143 and 144 have all been spirally wound and oblately flattened into a generally planar, substantially rectangular pad-like configuration, wherein each hingedly connected adjacent pair of said panels is on opposite sides of a center plane of the pad-like configuration. Of course, these successsive panels 135–145, progressively outwardly, are each necessarily wider than the next adjacent inward panel, as required by paper thickness of the sheet in order to properly fold into the tight oblate flat spiral configuration with panels in generally congruent overlying relation. While this is apparent in FIGS. 1, 2 and 3, the dimension of paper thickness is incapable of being shown in the drawings, and in practice is substantially negligible. As the folder 130 is made from a tightly wound spiral, by the method and apparatus of U.S. Pat. No. 4,136,860 with adjacent convolutions in complete and continuous contact with each other, the adjacent convolutions remain in such contact upon flattening of the spiral to its oblate condition. Thus, the flattened folder 130 defines a generally planar pad of tight oblate flat spiral configuration with its adjacent convolutions in full and complete contact with one another by this construction a very minimum of space is occupied by the folder, and the folder is of an optimum strength and staunchness for reliable handling by automatic machinery.

Further, the generally planar pad-like package or folder 130 is effectively secured in its closed, pad configuration by suitable securement means, such as adhesive 155 interposed between the endmost outer panel 144 and its next adjacent facing panel 142. The intermediate space 51 of indicia 50 on panel 42 may permit of adhesive securement without defacing indicia. By the flat spiral configuration, and the form retention of the several folds 116–124, the folder 130 effectively retains its flattened configuration. Except for the adhesive securement 155, adhesive is entirely absent from between the panels 135–144, which enables the folder 130 to be inexpensively formed by coiling about a mandrel and flattening upon removal from the mandrel.

Further, the folder 130 may be secured to any suitable container, say a box, or other, by suitable adhesive securement, or otherwise, if desired. In this manner, the folder 130 may be deliberately removed from its associated container, without inadvertent or accidental removal, and the folder may subsequently be opened and the indicia observed without in any way being defaced by the adhesive, or other.

For example, the several areas of indicia, namely 46–50 will all be exposed to view on one side of the strip, upon its being unwound.

Also, if the sheet 30 would be imprinted on its opposite side with identical indicia to that described hereinbefore, it will be understood that the several strips may be wound in either direction, as desired.

Although the present invention has been described in some detail by way of illustration and example for purposes of clarity of understanding, it is understood that certain changes and modifications may be made within the spirit of the invention.

I claim:

1. An information folder construction comprising a strip of flexible and foldable paper sheet material, a plurality of at least three generally equally spaced parallel scores formed in said strip generally normal to the longitudinal strip dimension, said scores defining of the strip material a plurality of at least four generally rectangular panels, informative indicia marked on said strip including identifying indicia on a front panel adjacent to one end panel, and folds along said scores all facing toward one side of said strip and hingedly connecting said panels for swinging movement into generally congruent overlying relation with each other defining a generally planar pad of tight oblate flat spiral configuration wound about the other end panel having adjacent convolutions in complete and, continuous contact with each other, said front panel and said one end panel being outermost on opposite sides of said pad, and detachable adhesive securement means interposed between and securing only said one end panel to the next adjacent underlying panel, the remaining panels being entirely free of adhesive and unsecured except for said hinged connections, to releasably retain said panels in pad defining relation.

2. An information folder construction according to claim 1, said informative indicia being located on the same surface of said strip as said identifying indicia for single surface printing.

3. An information folder construction according to claim 2, said informative indicia being at spaced locations on the panel which is hingedly connected to the front panel inwardly of the strip in the direction away from said one end panel to provide an unprinted space for said detachable securement means.

4. An information folder construction according to claim 1, each convolution of said spiral including a pair of said panels in flat parallel facing relation, one of said scores integrally connecting said pair of panels along one side thereof, and another of said scores extending integrally from one panel of said pair along the other side thereof for connection to a panel of the next adjacent convolution.

5. An information folder construction according to claim 4, said informative indicia being located on the same surface of said strip as said identifying indicia for single surface printing, and additional information indicia on the other surface of said strip, said first mentioned and additional informative indicia being identical, for winding of said strip with either end panel innermost.

* * * * *